US011855347B2

(12) United States Patent
Eylander et al.

(10) Patent No.: US 11,855,347 B2
(45) Date of Patent: Dec. 26, 2023

(54) RADIAL FEED SEGMENTATION USING WEDGE PLATES RADIAL WAVEGUIDE

(71) Applicant: Kymeta Corporation, Redmond, WA (US)

(72) Inventors: Chris Eylander, Redmond, WA (US); Bradley Eylander, Kent, WA (US); Mohsen Sazegar, Kirkland, WA (US)

(73) Assignee: KYMETA CORPORATION, Redmond, WA (US)

( * ) Notice: Subject to any disclaimer, the term of this patent is extended or adjusted under 35 U.S.C. 154(b) by 291 days.

(21) Appl. No.: 17/124,061

(22) Filed: Dec. 16, 2020

(65) Prior Publication Data

US 2021/0249779 A1 Aug. 12, 2021

Related U.S. Application Data

(60) Provisional application No. 62/955,079, filed on Dec. 30, 2019.

(51) Int. Cl.
*H01Q 21/00* (2006.01)
*H01Q 15/00* (2006.01)
(Continued)

(52) U.S. Cl.
CPC ..... *H01Q 15/0086* (2013.01); *H01P 3/023* (2013.01); *H01Q 1/48* (2013.01); *H01Q 21/0012* (2013.01); *H01P 3/06* (2013.01)

(58) Field of Classification Search
CPC ..... H01Q 1/48; H01Q 15/00; H01Q 21/0012; H01Q 21/00
See application file for complete search history.

(56) References Cited

U.S. PATENT DOCUMENTS 8,451,189 B1 * 5/2013 Fluhler ..... H01Q 15/0086 343/756
10,181,646 B2 * 1/2019 Celik ..... H01Q 9/0407
(Continued)

FOREIGN PATENT DOCUMENTS

JP 2007013321 A 1/2007
KR 1020160008958 A 1/2016

OTHER PUBLICATIONS

International Preliminary Report ad Written Opinion on the Patentability of Application No. PCT/US2020/066238 dated Jul. 14, 2022, 6 pages.

(Continued)

*Primary Examiner* — Hasan Islam
(74) *Attorney, Agent, or Firm* — Womble Bond Dickinson (US) LLP

(57) ABSTRACT

An antenna having a wedge plate-based waveguide with feed segmentation and a method for using the same are disclosed. In one embodiment, the antenna comprises an aperture having an array of radio-frequency (RF) radiating antenna elements and a segmented wedge plate radial waveguide comprises a plurality of wedge plates that form a plurality of sub-apertures, wherein each sub-aperture includes one wedge plate and a distinct subset of RF radiating antenna elements in the array, wherein each wedge plate of the plurality of wedge plates has a feed point to provide a feed wave for propagation through said each wedge plate for interaction with its distinct subset of RF radiating antenna elements in the array.

13 Claims, 14 Drawing Sheets

(51) Int. Cl.

| | |
|---|---|
| ***H01P 3/02*** | (2006.01) |
| ***H01Q 1/48*** | (2006.01) |
| *H01P 3/06* | (2006.01) |

(56) References Cited

U.S. PATENT DOCUMENTS

| | | | |
|---|---|---|---|
| 2014/0028524 | A1 | 1/2014 | Jerauld et al. |
| 2018/0123260 | A1 | 5/2018 | Sikes et al. |
| 2019/0097299 | A1 | 3/2019 | Fotheringham et al. |
| 2019/0386392 | A1* | 12/2019 | Boutayeb ..... H01Q 21/0031 |

OTHER PUBLICATIONS

International Search Report and Written Opinion on the Patentability of Application No. PCT/US2020/066238 dated Apr. 26, 2021, 11 pages.

* cited by examiner

RADIAL FEED SEGMENTATION USING WEDGE PLATES RADIAL WAVEGUIDE

PRIORITY

The present application is a non-provisional application of and claims the benefit of U.S. Provisional Patent Application No. 62/955,079 filed Dec. 30, 2019 and entitled "Radial Feed Segmentation Using Wedge Plates Radial Waveguide", which is incorporated by reference in its entirety.

FIELD OF THE INVENTION

Embodiments of the invention are related to wireless communication; more particularly, embodiments of invention are related to an antenna having a wedge plate-based waveguide.

BACKGROUND

Tiling or segmentation is a common method of fabricating phased array and static array antennas to help reduce the issues associated with fabricating such antennas. When fabricating large antenna arrays, the large antenna arrays are usually segmented into LRUs (Line Replaceable Units) that are identical segments. Aperture tiling or segmentation is very common for large antennas, especially for complex systems such as phased arrays.

Segmentation has been found to provide a tiling approach for cylindrical feed antennas. See for example, U.S. Pat. No. 9,887,455, entitled "Aperture segmentation of a cylindrical feed antenna", filed Mar. 3, 2016 and issued Feb. 6, 2018.

Some current antennas can form multiple beams (e.g., beam 1 and beam 2) can form multiple beam but there are issues of determining on which beam a signal was received.

SUMMARY

An antenna having a wedge plate-based waveguide with feed segmentation and a method for using the same are disclosed. In one embodiment, the antenna comprises an aperture having an array of radio-frequency (RF) radiating antenna elements and a segmented wedge plate radial waveguide comprises a plurality of wedge plates that form a plurality of sub-apertures, wherein each sub-aperture includes one wedge plate and a distinct subset of RF radiating antenna elements in the array, wherein each wedge plate of the plurality of wedge plates has a feed point to provide a feed wave for propagation through said each wedge plate for interaction with its distinct subset of RF radiating antenna elements in the array.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Figure 1:
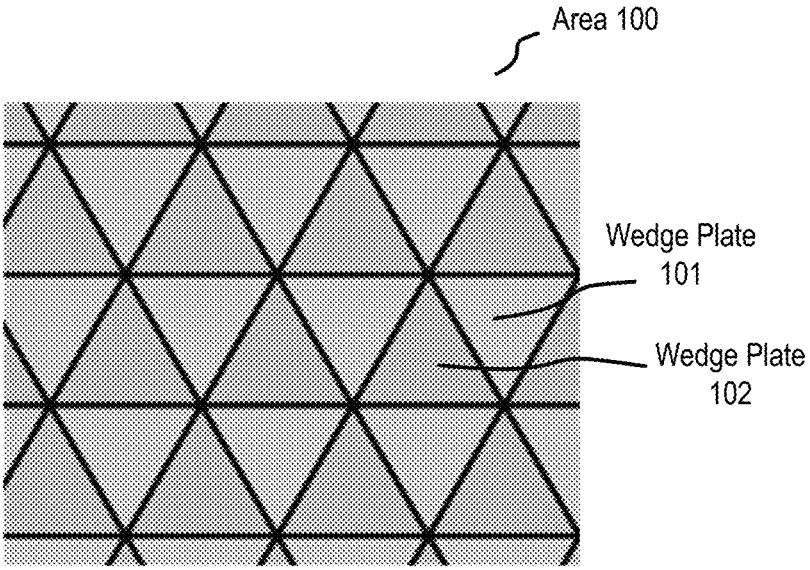
FIGS. 1 and 2 illustrate examples of tiling of an antenna aperture using wedge plates.

Embodiments of antennas, a communication system that includes such an antenna, and a method for using the same are described herein. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In one embodiment, the antenna has an aperture that is divided into segments or sub-apertures using wedge plates. In one embodiment, the wedge plates are TE10 wedge plates. Other wedge plates may be used. In one embodiment, the antenna has an array of radio-frequency (RF) radiating antenna elements. In one embodiment, the RF radiating antenna elements are surface scattering antenna elements and are part of a metasurface. Examples of such arrays and RF radiating antenna elements are described in more detail below.

In one embodiment, the antenna has an aperture segmented into multiple sub-apertures that are coupled together to form a cylindrical aperture, where each sub-aperture has a corresponding wedge plate. Together, the wedge plates of the sub-apertures operate as a segmented wedge plate radial waveguide, with each sub-aperture including one wedge plate to provide a feed wave to a distinct subset of RF radiating antenna elements in the array of antenna elements. In one embodiment, each wedge plate has a feed point to provide a feed wave for propagation (through the wedge plate) for interaction with its distinct subset of RF radiating antenna elements in the array. In one embodiment, the feed points of the wedge plates are located centrally with respect to the cylindrically-shaped aperture. In this case, the feed of the antenna comprises a segmented feed. In one embodiment, the segmented feed appears to the antenna as a single feed.

In one embodiment, the segmented, cylindrical antenna provides additional beam pointing functionality, such as, for example, producing multiple beams simultaneously (e.g., wedges pointing at different directions simultaneously). In one embodiment, the spatial characteristics of the surface currents for both the cylindrical antenna and the TE10 wedge plate waveguide differ only by a 90-degree rotation. This is true for the m=0, n=0 radial mode and the n=1, p=0 wedge plate mode. For the radial waveguide, the magnetic field is tangential to the surface along phi, whereas for the wedge plate the magnetic field is tangential to the surface but aligned along rho. The similarity of the two modes may be shown by the following two equations for a radial waveguide and a wedge plate waveguide:

Radial Waveguide:

$$Bz = \frac{n * pi}{h};$$

$$H_p^+ \sim H_m^{(2')}(B_p p)\cos(m\Phi)\cos\left(\frac{n * pi * z}{h}\right);$$

Normal mode operated TM0 (n=0)

Wedge Plate Waveguide:

$$H_p^+ \sim H_m^{(2')}(B_p p)\left(\frac{p * pi * \Phi}{h}\right)\cos\left(\frac{n * pi * z}{h}\right);$$

Hz exists as well but vanishes at the conductor surface

Normal mode operated (n=1)

Because the magnitude of both modes utilize the same Hankel function and the surface current vector maintains orthogonality to the element placement, this allows the wedge plate segmented feed to be used both separately and coherently. Coherent operation can result in identical beam pointing characteristics of the cylindrical antenna. In this case, specific antenna implementations with multiple substrates (e.g., glass layers for one or both patch and iris substrates), including those described below, and beam forming can work the same as described below but with additional multi-beam functionality added.

In one embodiment, multiple wedge plates are used for the cylindrical antenna to add multi-beam capabilities. That is, the antenna aperture is operable to generate multiple beams simultaneously. In such a case, at least two of the beams are generated via at least two wedge plates. In one embodiment, each of the wedge plates has a feed point. Since there are multiple feed points, the receive signals from sub-apertures can be commanded and spatially discriminated.

In one embodiment, the use of multiple wedge plates provides coefficient of thermal expansion (CTE) reduction. This results from that largest dimension of aperture now being divided by a factor of two.

While a segmented cylindrical antenna design is discussed herein, it should be noted that the wedge plate radial guide could be used as a stand-alone structure for tiling. An example of such tiling is shown above in FIGS. 1 and 2. In one embodiment, wedge plates with an equilateral triangle shape would be the most ideal for tiling. In one embodiment, the wedge plates are identical in size and shape to each other. Referring to FIG. 1, wedge plates, such as wedge plates 101 and 102, for example, are positioned and placed next to each other in a tile like manner (only area 100 partially shown). In this case, a wedge plate in a row of wedge plates have one or more abutting wedge plates that are positioned in a direction opposite to that of the wedge plate.

Figure 2:
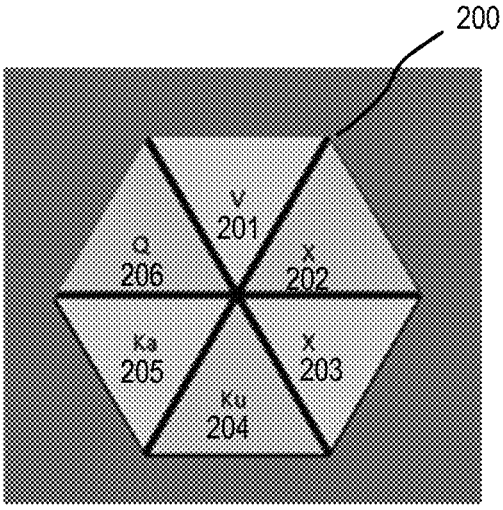

FIG. 2 illustrates another example of an antenna aperture comprising a number of tiles with wedge plates. Referring to FIG. 2, antenna 200 comprises an aperture with wedge plates 201-206 are shown. In one embodiment, each of wedge plates 201-206 is dedicated for use for a different frequency band (e.g., Ka band, Ku band, other bands (represented as Q, V, X in FIG. 2). In one embodiment, two or more tiles of the aperture may be used for the same band (e.g., wedge plates 202 and 203 for band X).

Note that building a tiling structure allows for increased product scalability.

In one embodiment, a massive multi-band antenna, potentially using same piece of glass, can be constructed using wedge plates.

Note that the arrangements described herein differ from prior art holographic antennas. In the prior art, linear arrays or radial arrays are used for holographic antennas. Linear arrays can be tiled but suffer from high discrete sidelobes from non-linearities coherently formed from a periodic structure. The mode in the cylindrical waveguide described herein spreads out the non-linearities resulting in superior sidelobe performance. The wedge plate radial waveguide has a similar radially symmetric mode structure as the cylindrical waveguide, which will result in same sidelobe characteristics. That is, the wave propagates radially out from the center of the aperture.

Figure 3:
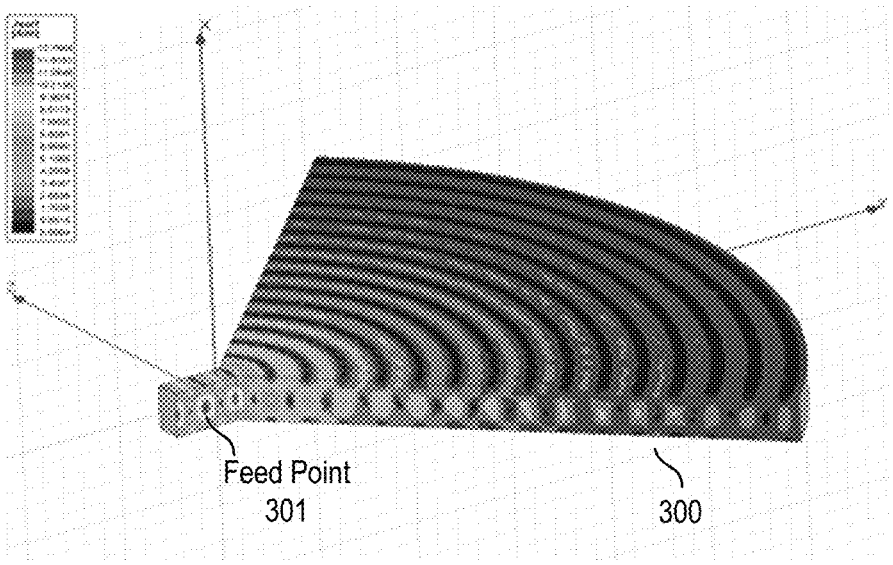
FIG. 3 illustrates one embodiment of a one 90° wedge plate radial guide.
Figure 4A:
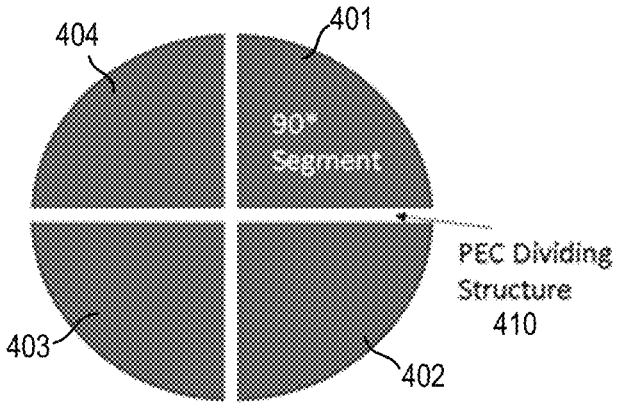
FIG. 4A illustrates one embodiment of an antenna aperture constructed with 90° segments/sub-apertures, each being 90° wedge plate radial guides.

FIG. 3 shows the magnitude of the surface current distribution on one 90° wedge plate radial guide. In one embodiment, four such 90° wedge plate radial guides 401-404 are combined and coupled together to create an antenna aperture, such as, for example, the antenna aperture shown in FIG. 4A. Referring to FIG. 3, wedge plate radial guide 300 includes a feed point 301. FIG. 4A shows fitting four wedge plates from radial guide 300 to create a larger aperture. Referring to FIG. 4A, an antenna aperture is shown having four such 90° wedge plate radial guides 401-404. In one embodiment, each of 90° wedge plate radial guides 401-404 has a feed point centrally-located in the aperture, such that there are four feed points.

In one embodiment, the antenna includes a boundary structure between each of the sub-apertures. In one embodiment, the boundary structure is between adjacent sides of adjacent sub-apertures. In one embodiment, there is a boundary structure 410 on the edges of the 90° wedge plate radial guides. Boundary structure 410 operates to prevent feed wave propagation from exiting one of the wedge plate radial guides and entering, or otherwise interfering with, an adjacent wedge plate radial guide. In one embodiment, boundary structure 410 comprises a metal perfect Electrical Conductor (PEC) boundary or other metal (e.g., aluminum, etc.) boundary structure on the edges.

Figure 4B:
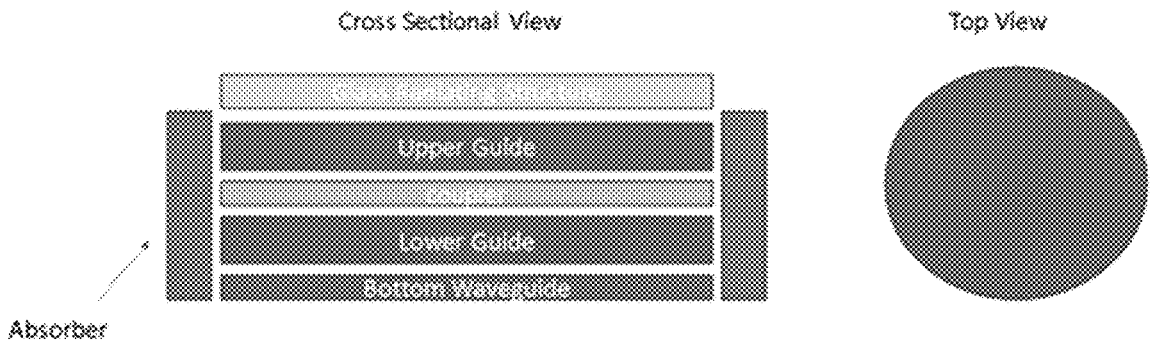
FIG. 4B illustrates an example of a cylindrical center-fed directional coupler.

In one embodiment, each sub-aperture comprises a directional coupler. FIG. 4B illustrates an example of a cylindrical center-fed directional coupler for a center-fed antenna aperture. In contrast, FIG. 4C illustrates one embodiment of a segmented wedge plate radial guide center-fed directional coupler.

In one embodiment, the wedge plate waveguide comprising a rectangle (FIG. 4D) or a triangle (FIG. 4E) is fed from multiple sides without a boundary as an interference wedge plate. For example, the rectangular wedge plate waveguide of FIG. 4D is shown with feed points 441-444, while the triangular wedge plate waveguide of FIG. 4E is shown with feed points 451-453. The interference wedge plate supporting orthogonal modes can be used in advanced beam forming techniques to support multiple beams or increase instantaneous bandwidth.

Figure 4C:
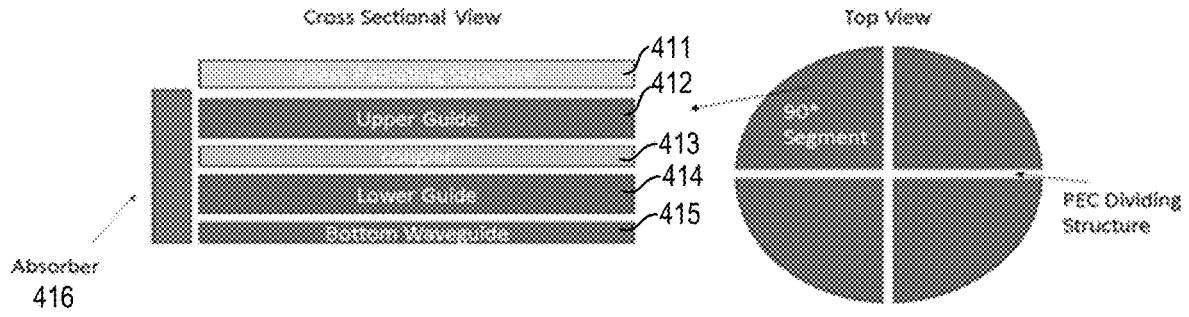
FIG. 4C illustrates one embodiment of a segmented wedge plate radial guide center-fed directional coupler.
Figure 4E:
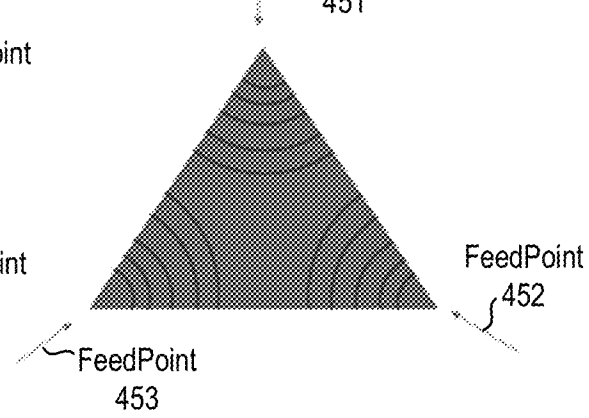
FIG. 4E illustrates one embodiment of a triangular wedge plate waveguide.
Figure 4D:
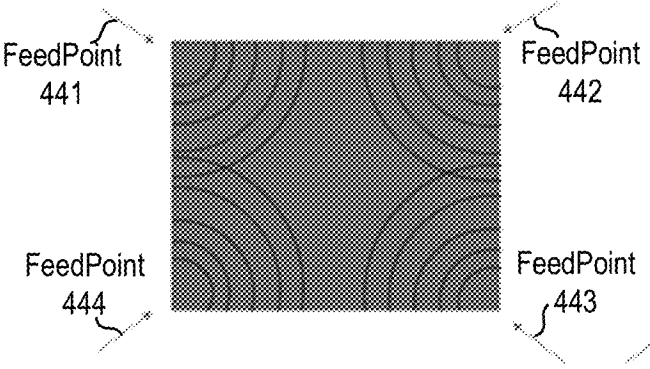
FIG. 4D illustrates one embodiment of a rectangular wedge plate waveguide.

Referring to FIG. 4C, a segmented wedge plate radial guide center-fed directional coupler comprises an RF array structure 411 that contains RF radiating antenna elements (e.g., surface scattering antenna elements), an upper guide 412 below RF array structure 411, a coupler 413 beneath upper guide 412, a lower guide 414 beneath coupler 413, a bottom waveguide 415 in a wedge plate and absorber 416. Note that there is no absorber on the right side as in FIG. 4B as a boundary structure between the segmented wedge plate radial guide would prevent RF energy of one segmented wedge plate radial guide from propagating and interfering with an adjacent segmented wedge plate radial guide.

In operation, a feed wave is fed into the segmented wedge plate radial guide center-fed directional coupler from the right-side of bottom waveguide 415 (as shown) and propagates toward absorber 416. While propagating, the feed wave propagates into lower guide 414, through coupler 413, which couples the feed wave through to upper guide 412 for interaction with antenna elements that are part of RF array structure 411. In one embodiment, RF array structure 411 comprises a pair of substrates (e.g., glass substrates) having patches and irises with liquid crystal or another dielectric layer in between as described below. In one embodiment, the interaction between the feed wave and the antenna elements results in the formation of a beam, as described in more detail below and is well-known in the art. Any remaining RF energy in the feed wave is absorbed by absorber 416.

Figure 5:
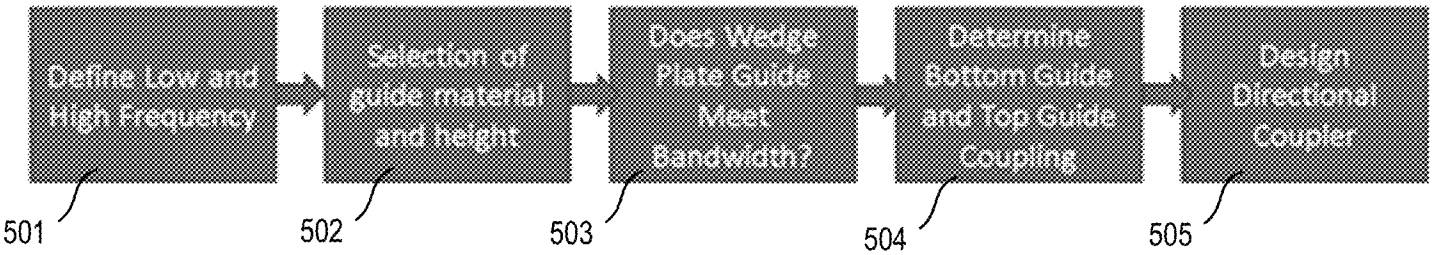
FIG. 5 illustrates a flow diagram of a one embodiment of a design process for a directional coupler.

FIG. 5 illustrates a flow diagram of a one embodiment of a process for designing a segmented wedge plate radial guide center-fed directional coupler. Referring to FIG. 5, the process begins by defining the low and high frequencies of the segmented wedge plate radial guide center-fed directional coupler (501). Next, based on the low and high frequencies, the guide material and height of the guide are selected (502). The selection of a guide material may include the use of a material with a permittivity or dielectric constant of 1.5 to 3.0. A change in the height of the guide may result in selection of a material with a different permittivity or dielectric constant than this. Based on the low and high frequencies and the selected guide material and height, the design is checked to determine whether it meets the desired bandwidth (503). If so, the coupling of the lower guide and the upper guide are determined (504). With this information, the directional coupler is designed (505).

Figure 6:
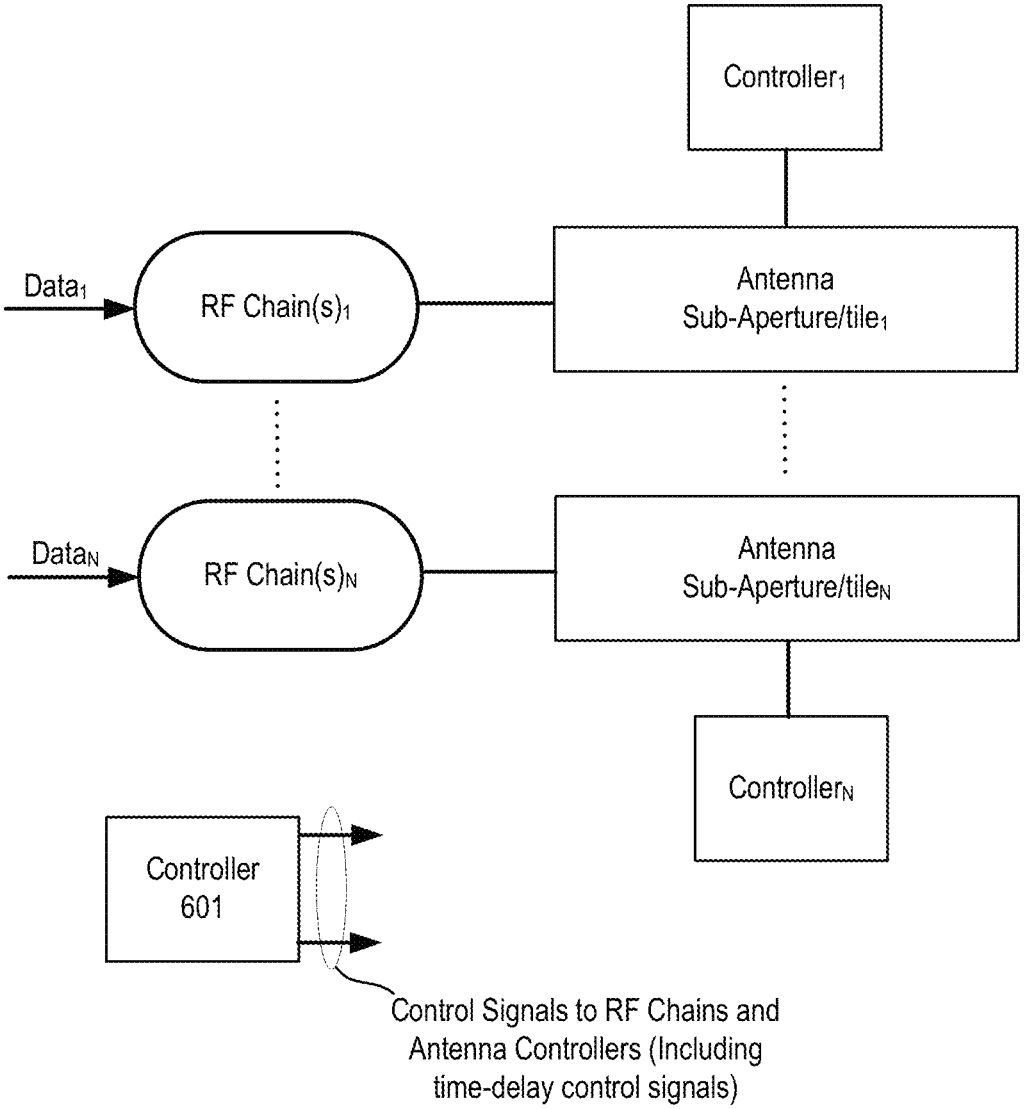
FIG. 6 illustrates one embodiment of an antenna with each sub-aperture having its own radio-frequency (RF) chain.

In one embodiment, each of the sub-apertures or segmented wedge plate radial guide center-fed directional coupler has its own RF chain. Thus, in such a case, the antenna includes multiple RF chains and a plurality of ports, wherein one RF chain in the plurality of RF chains is coupled to one port of the plurality of ports and each port is associated with one sub-aperture of the plurality of sub-apertures. In one embodiment, each segment has its own transmit RF chain and a receive RF chain. FIG. 6 illustrates an example. In one embodiment, the RF chains may be the same as depicted in and described in conjunction with FIG. 14 with a controller for each antenna sub-aperture.

As discussed above, sub-apertures are operated coherently together and each produces its own beam. In one embodiment, they are operated together by, at least in part, coordinating feed wave propagation through the wedge plate radial guides.

With current antennas, multiple beams (e.g., beam 1 and beam 2) can be formed but when a signal is received it is unknown whether it was received using a particular beam (e.g., received via beam 1 or beam 2). By creating multiple feed points (one for each wedge plate), spatial discrimination can be performed to determine on which beam a signal was received. Additionally, all sub-apertures can be operated coherently together. In one embodiment, the receive RF chains include processing circuitry to perform the spatial discrimination to determine on which of the multiple beams a signal is received. In another embodiment, post processing software executed by a controller (e.g., one or more processors) in the antennas performs the spatial discrimination to determine on which of the multiple beams a signal is received.

In one embodiment, a controller controls the RF chains and the segment/sub-aperture feeds so that one or more of the feeds is time-delayed with respect to the others. That is, in one embodiment, at least one wedge plate of the multiple wedge plates that are part of the antenna aperture is fed with a first feed wave that is time-delayed with respect to a second feed wave that is fed to another of the wedge plates. The time delay is a true time-delay (TTD) and its introduction causes a broadening of the bandwidth of the antenna. In one embodiment, the TDD may be implemented physically with a longer waveguide that represents some time delta in comparison to another waveguide.

In another embodiment, the antenna may include an RF combiner to combine signals from the ports of multiple segmented wedge plate radial guide into one or more signals.

Examples of Antenna Embodiments

The techniques described above may be used with flat panel antennas. Embodiments of such flat panel antennas are disclosed. The flat panel antennas include one or more arrays of antenna elements on an antenna aperture. In one embodiment, the antenna elements comprise liquid crystal cells. In one embodiment, the flat panel antenna is a cylindrically fed antenna that includes matrix drive circuitry to uniquely address and drive each of the antenna elements that are not placed in rows and columns. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

Examples of Antenna Systems

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Antenna Elements

Figure 7A:
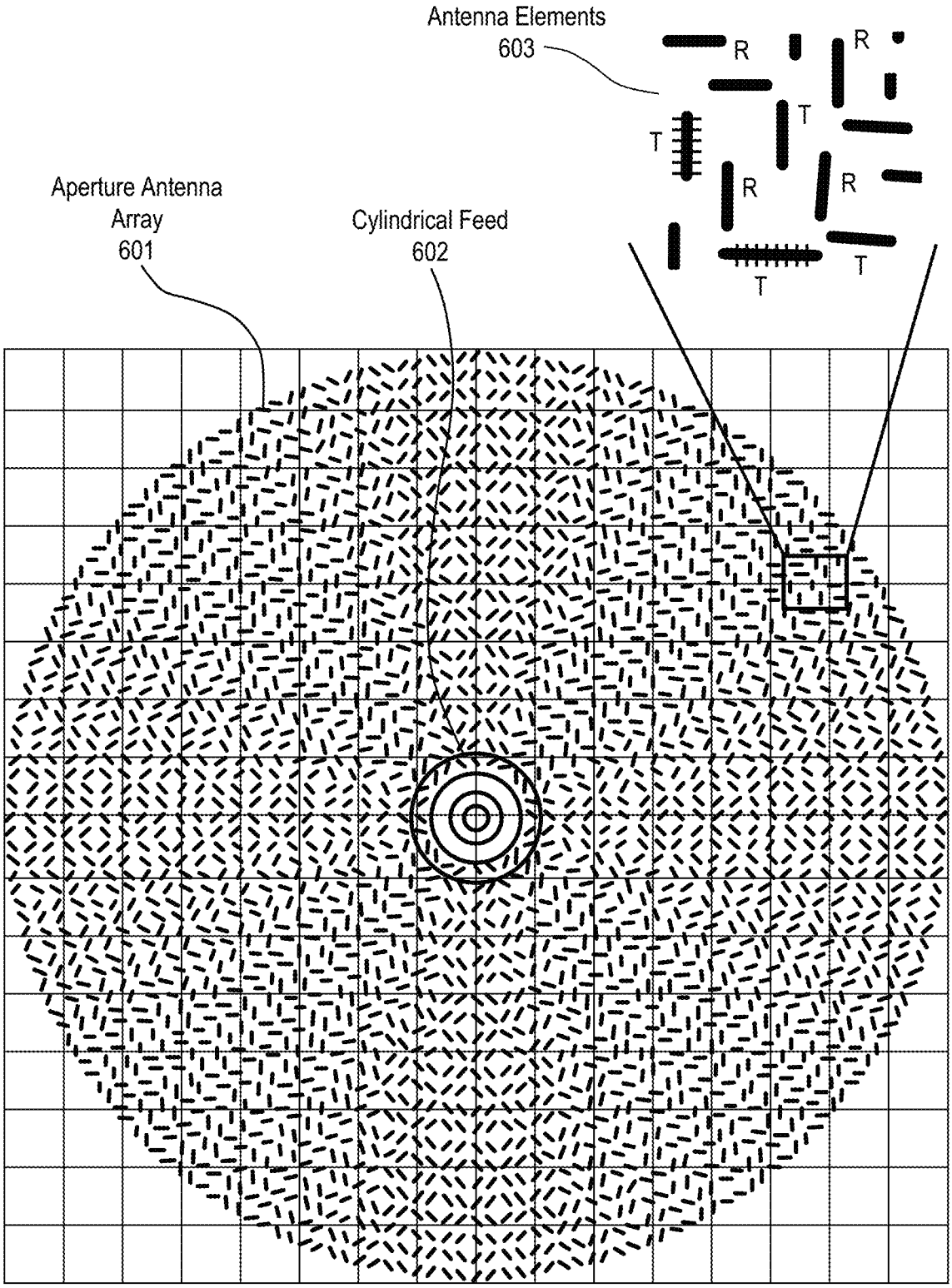
FIG. 7A illustrates an aperture having one or more arrays of antenna elements placed in concentric rings around an input feed of the cylindrically fed antenna.

FIG. 7A illustrates the schematic of one embodiment of a cylindrically fed holographic radial aperture antenna. Referring to FIG. 7A, the antenna aperture has one or more arrays 601 of antenna elements 603 that are placed in concentric rings around an input feed 602 of the cylindrically fed antenna. In one embodiment, antenna elements 603 are radio frequency (RF) resonators that radiate RF energy. In one embodiment, antenna elements 603 comprise both Rx and Tx irises that are interleaved and distributed on the whole surface of the antenna aperture. Examples of such antenna elements are described in greater detail below. Note that the RF resonators described herein may be used in antennas that do not include a cylindrical feed.

In one embodiment, the antenna includes a coaxial feed that is used to provide a cylindrical wave feed via input feed 602. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

In one embodiment, antenna elements 603 comprise irises and the aperture antenna of FIG. 7A is used to generate a main beam shaped by using excitation from a cylindrical feed wave for radiating irises through tunable liquid crystal (LC) material. In one embodiment, the antenna can be excited to radiate a horizontally or vertically polarized electric field at desired scan angles.

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor. As would be understood by those skilled in the art, LC in the context of CELC refers to inductance-capacitance, as opposed to liquid crystal.

In one embodiment, a liquid crystal (LC) is disposed in the gap around the scattering element. This LC is driven by the direct drive embodiments described above. In one embodiment, liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty-five degree (45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them+/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, as discussed above, a matrix drive is used to apply voltage to the patches in order to drive each cell separately from all the other cells without having a separate connection for each cell (direct drive). Because of the high density of elements, the matrix drive is an efficient way to address each cell individually.

In one embodiment, the control structure for the antenna system has 2 main components: the antenna array controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude or duty cycle of an AC bias signal to that element.

In one embodiment, the antenna array controller also contains a microprocessor executing the software. The control structure may also incorporate sensors (e.g., a GPS receiver, a three-axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the antenna array controller controls which elements are turned off and those elements turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 7B:
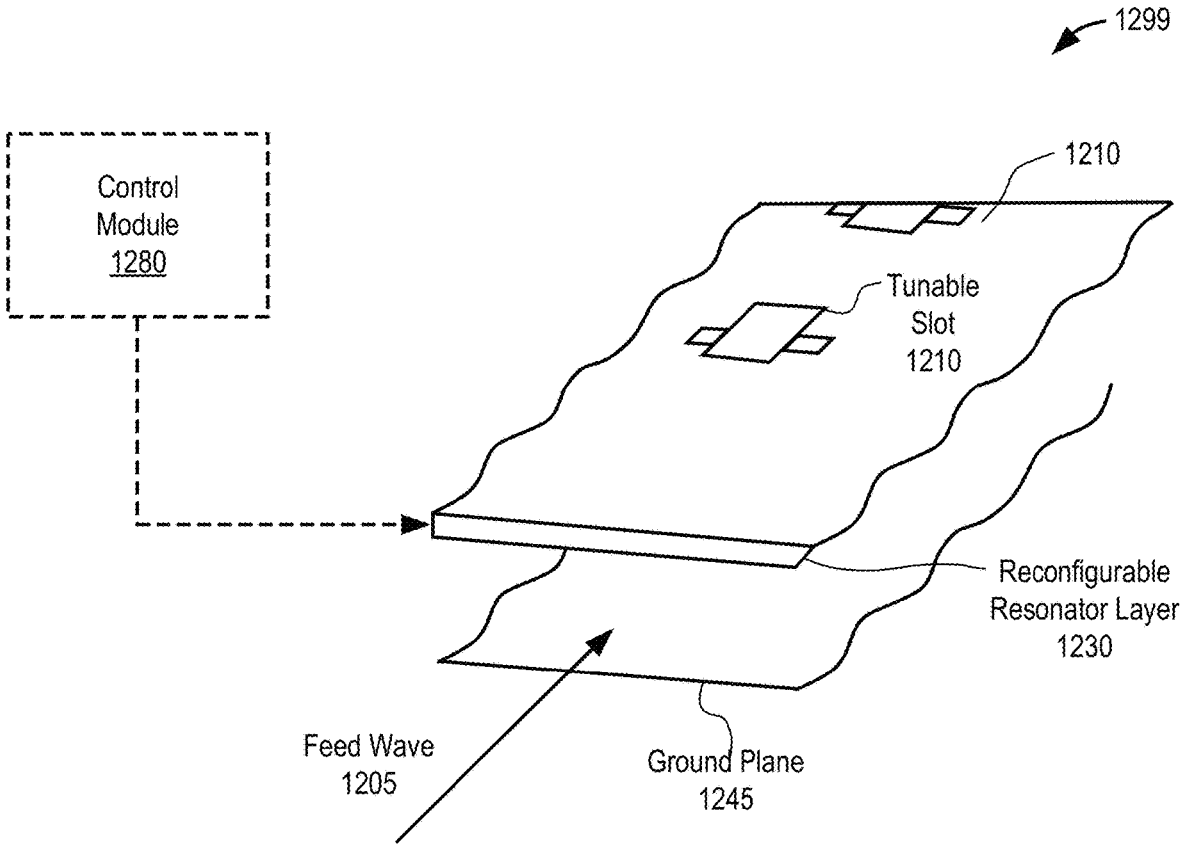
FIG. 7B illustrates a perspective view of one row of antenna elements that includes a ground plane and a reconfigurable resonator layer.

FIG. 7B illustrates a perspective view of one row of antenna elements that includes a ground plane and a reconfigurable resonator layer. Reconfigurable resonator layer 1230 includes an array of tunable slots 1210. The array of tunable slots 1210 can be configured to point the antenna in a desired direction. Each of the tunable slots can be tuned/adjusted by varying a voltage across the liquid crystal.

Figure 8A:
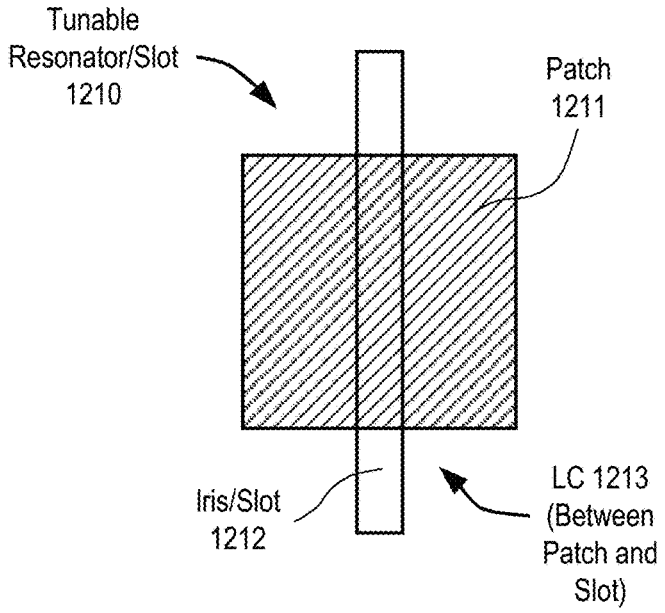
FIG. 8A illustrates one embodiment of a tunable resonator/slot.

Control module 1280 is coupled to reconfigurable resonator layer 1230 to modulate the array of tunable slots 1210 by varying the voltage across the liquid crystal in FIG. 8A. Control module 1280 may include a Field Programmable Gate Array ("FPGA"), a microprocessor, a controller, System-on-a-Chip (SoC), or other processing logic. In one embodiment, control module 1280 includes logic circuitry (e.g., multiplexer) to drive the array of tunable slots 1210. In one embodiment, control module 1280 receives data that includes specifications for a holographic diffraction pattern to be driven onto the array of tunable slots 1210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 1280 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w^*_{in}w_{out}$, with $w_{in}$ as the wave equation in the waveguide and $w_{out}$ the wave equation on the outgoing wave.

FIG. 8A illustrates one embodiment of a tunable resonator/slot 1210. Tunable slot 1210 includes an iris/slot 1212, a radiating patch 1211, and liquid crystal 1213 disposed between iris 1212 and patch 1211. In one embodiment, radiating patch 1211 is co-located with iris 1212.

Figure 8B:
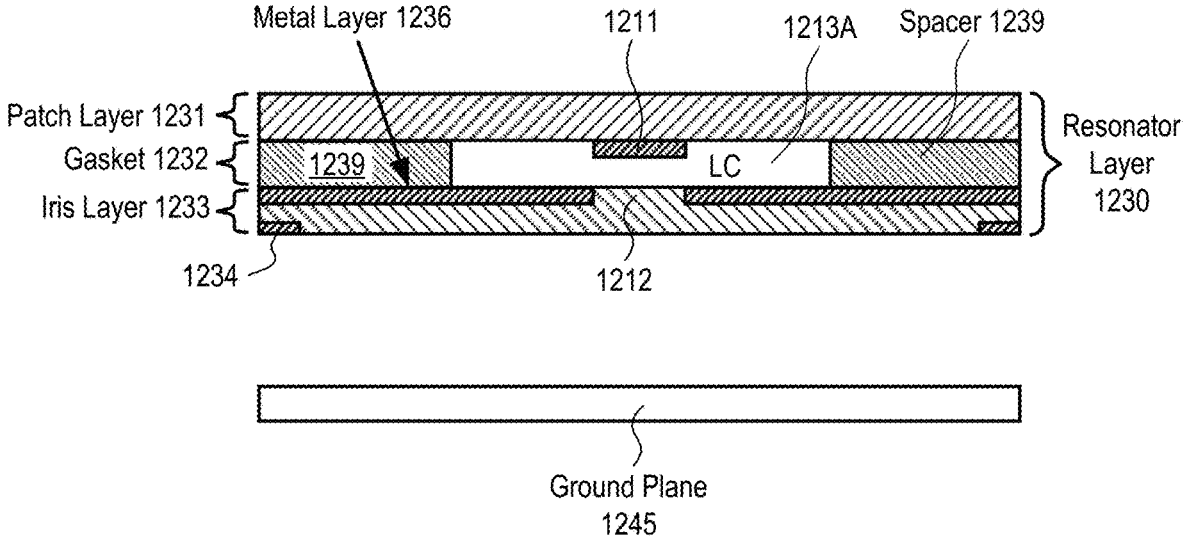
FIG. 8B illustrates a cross section view of one embodiment of a physical antenna aperture.

FIG. 8B illustrates a cross section view of one embodiment of a physical antenna aperture. The antenna aperture includes ground plane 1245, and a metal layer 1236 within iris layer 1233, which is included in reconfigurable resonator layer 1230. In one embodiment, the antenna aperture of FIG. 8B includes a plurality of tunable resonator/slots 1210 of FIG. 8A. Iris/slot 1212 is defined by openings in metal layer 1236. A feed wave, such as feed wave 1205 of FIG. 8A, may have a microwave frequency compatible with satellite communication channels. The feed wave propagates between ground plane 1245 and resonator layer 1230.

Reconfigurable resonator layer 1230 also includes gasket layer 1232 and patch layer 1231. Gasket layer 1232 is disposed between patch layer 1231 and iris layer 1233. Note that in one embodiment, a spacer could replace gasket layer 1232. In one embodiment, iris layer 1233 is a printed circuit board ("PCB") that includes a copper layer as metal layer 1236. In one embodiment, iris layer 1233 is glass. Iris layer 1233 may be other types of substrates.

Openings may be etched in the copper layer to form slots 1212. In one embodiment, iris layer 1233 is conductively coupled by a conductive bonding layer to another structure (e.g., a waveguide) in FIG. 8B. Note that in an embodiment the iris layer is not conductively coupled by a conductive bonding layer and is instead interfaced with a non-conducting bonding layer.

Patch layer 1231 may also be a PCB that includes metal as radiating patches 1211. In one embodiment, gasket layer 1232 includes spacers 1239 that provide a mechanical standoff to define the dimension between metal layer 1236 and patch 1211. In one embodiment, the spacers are 75 microns, but other sizes may be used (e.g., 3-200 mm). As mentioned above, in one embodiment, the antenna aperture of FIG. 8B includes multiple tunable resonator/slots, such as tunable resonator/slot 1210 includes patch 1211, liquid crystal 1213, and iris 1212 of FIG. 8A. The chamber for liquid crystal 1213 is defined by spacers 1239, iris layer 1233 and metal layer 1236. When the chamber is filled with liquid crystal, patch layer 1231 can be laminated onto spacers 1239 to seal liquid crystal within resonator layer 1230.

A voltage between patch layer 1231 and iris layer 1233 can be modulated to tune the liquid crystal in the gap between the patch and the slots (e.g., tunable resonator/slot 1210). Adjusting the voltage across liquid crystal 1213 varies the capacitance of a slot (e.g., tunable resonator/slot 1210). Accordingly, the reactance of a slot (e.g., tunable resonator/slot 1210) can be varied by changing the capacitance. Resonant frequency of slot 1210 also changes according to the equation $$f = \frac{1}{2\pi\sqrt{LC}}$$

where f is the resonant frequency of slot 1210 and L and C are the inductance and capacitance of slot 1210, respectively. The resonant frequency of slot 1210 affects the energy radiated from feed wave 1205 propagating through the waveguide. As an example, if feed wave 1205 is 20 GHz, the resonant frequency of a slot 1210 may be adjusted (by varying the capacitance) to 17 GHz so that the slot 1210 couples substantially no energy from feed wave 1205. Or, the resonant frequency of a slot 1210 may be adjusted to 20 GHz so that the slot 1210 couples energy from feed wave 1205 and radiates that energy into free space. Although the examples given are binary (fully radiating or not radiating at all), full gray scale control of the reactance, and therefore the resonant frequency of slot 1210 is possible with voltage variance over a multi-valued range. Hence, the energy radiated from each slot 1210 can be finely controlled so that detailed holographic diffraction patterns can be formed by the array of tunable slots.

In one embodiment, tunable slots in a row are spaced from each other by λ/5. Other spacings may be used. In one embodiment, each tunable slot in a row is spaced from the closest tunable slot in an adjacent row by λ/2, and, thus, commonly oriented tunable slots in different rows are spaced by λ/4, though other spacings are possible (e.g., λ/5, λ/6.3). In another embodiment, each tunable slot in a row is spaced from the closest tunable slot in an adjacent row by λ/3.

Embodiments use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015.

FIGS. 9A-D illustrate one embodiment of the different layers for creating the slotted array. The antenna array includes antenna elements that are positioned in rings, such as the example rings shown in FIG. 7A. Note that in this example the antenna array has two different types of antenna elements that are used for two different types of frequency bands.

Figure 9A:
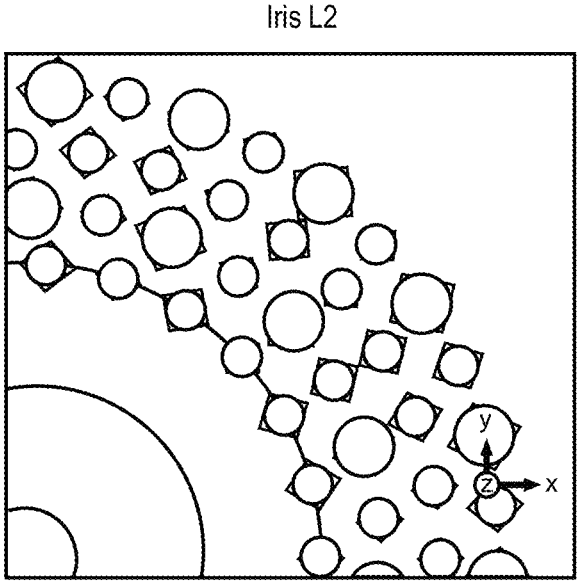
FIGS. 9A-D illustrate one embodiment of the different layers for creating the slotted array.
Figure 9B:
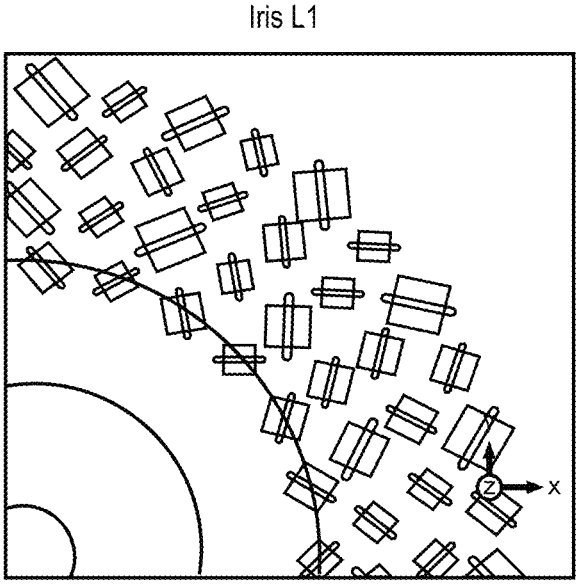
Figure 9C:
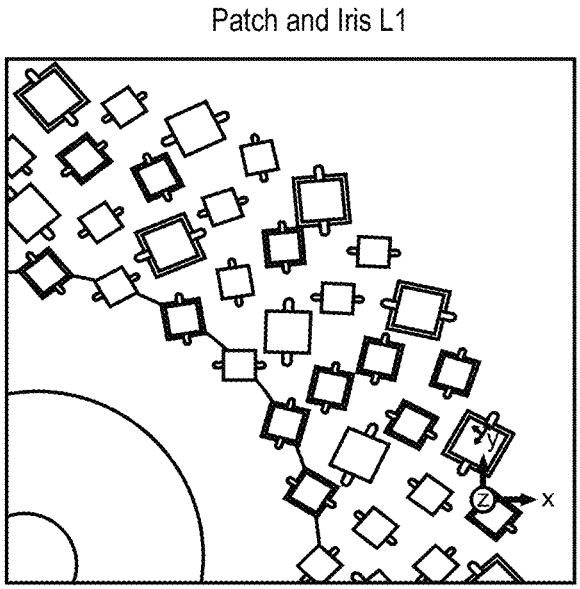
Figure 9D:
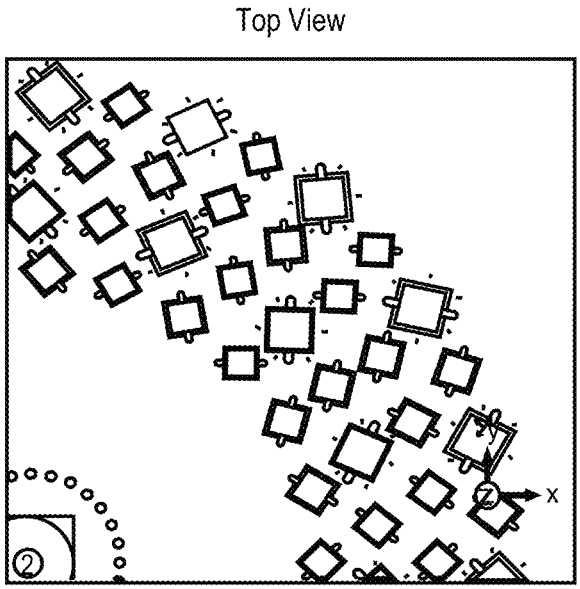

FIG. 9A illustrates a portion of the first iris board layer with locations corresponding to the slots. Referring to FIG. 9A, the circles are open areas/slots in the metallization in the bottom side of the iris substrate, and are for controlling the coupling of elements to the feed (the feed wave). Note that this layer is an optional layer and is not used in all designs. FIG. 9B illustrates a portion of the second iris board layer containing slots. FIG. 9C illustrates patches over a portion of the second iris board layer. FIG. 9D illustrates a top view of a portion of the slotted array.

Figure 10:
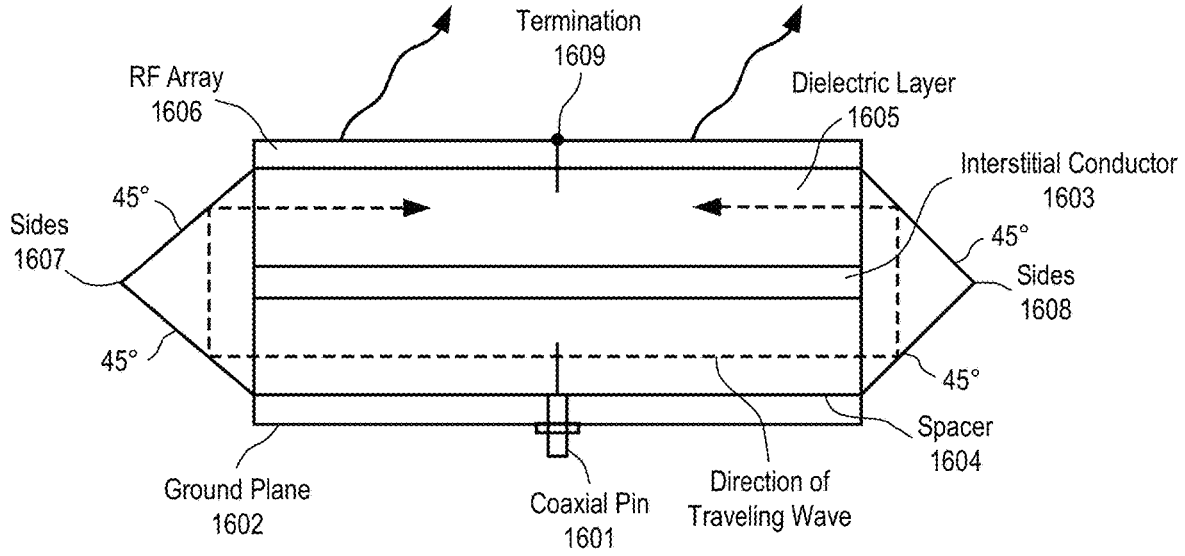
FIG. 10 illustrates a side view of one embodiment of a cylindrically fed antenna structure.

FIG. 10 illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 10 includes a coaxial feed, such as, for example, described in U.S. Publication No. 2015/0236412, entitled "Dynamic Polarization and Coupling Control from a Steerable Cylindrically Fed Holographic Antenna", filed on Nov. 21, 2014.

Referring to FIG. 10, a coaxial pin 1601 is used to excite the field on the lower level of the antenna. In one embodiment, coaxial pin 1601 is a 50Ω coax pin that is readily available. Coaxial pin 1601 is coupled (e.g., bolted) to the bottom of the antenna structure, which is conducting ground plane 1602.

Separate from conducting ground plane 1602 is interstitial conductor 1603, which is an internal conductor. In one embodiment, conducting ground plane 1602 and interstitial conductor 1603 are parallel to each other. In one embodiment, the distance between ground plane 1602 and interstitial conductor 1603 is 0.1-0.15". In another embodiment, this distance may be λ/2, where λ is the wavelength of the travelling wave at the frequency of operation.

Ground plane 1602 is separated from interstitial conductor 1603 via a spacer 1604. In one embodiment, spacer 1604 is a foam or air-like spacer. In one embodiment, spacer 1604 comprises a plastic spacer.

On top of interstitial conductor 1603 is dielectric layer 1605. In one embodiment, dielectric layer 1605 is plastic. The purpose of dielectric layer 1605 is to slow the travelling wave relative to free space velocity. In one embodiment, dielectric layer 1605 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1605, such as periodic sub-wavelength metallic structures that can be machined or lithographically defined, for example.

An RF-array 1606 is on top of dielectric 1605. In one embodiment, the distance between interstitial conductor 1603 and RF-array 1606 is 0.1-0.15". In another embodiment, this distance may be $\lambda_{eff}/2$, where $\lambda_{eff}$ is the effective wavelength in the medium at the design frequency.

The antenna includes sides 1607 and 1608. Sides 1607 and 1608 are angled to cause a travelling wave feed from coax pin 1601 to be propagated from the area below interstitial conductor 1603 (the spacer layer) to the area above interstitial conductor 1603 (the dielectric layer) via reflection. In one embodiment, the angle of sides 1607 and 1608 are at 45° angles. In an alternative embodiment, sides 1607 and 1608 could be replaced with a continuous radius to achieve the reflection. While FIG. 10 shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step. The steps on one end of the antenna go around the dielectric layer, interstitial the conductor, and the spacer layer. The same two steps are at the other ends of these layers.

In operation, when a feed wave is fed in from coaxial pin 1601, the wave travels outward concentrically oriented from coaxial pin 1601 in the area between ground plane 1602 and interstitial conductor 1603. The concentrically outgoing waves are reflected by sides 1607 and 1608 and travel inwardly in the area between interstitial conductor 1603 and RF array 1606. The reflection from the edge of the circular perimeter causes the wave to remain in phase (i.e., it is an in-phase reflection). The travelling wave is slowed by dielectric layer 1605. At this point, the travelling wave starts interacting and exciting with elements in RF array 1606 to obtain the desired scattering.

To terminate the travelling wave, a termination 1609 is included in the antenna at the geometric center of the antenna. In one embodiment, termination 1609 comprises a pin termination (e.g., a 50Ω pin). In another embodiment, termination 1609 comprises an RF absorber that terminates unused energy to prevent reflections of that unused energy back through the feed structure of the antenna. These could be used at the top of RF array 1606.

Figure 11:
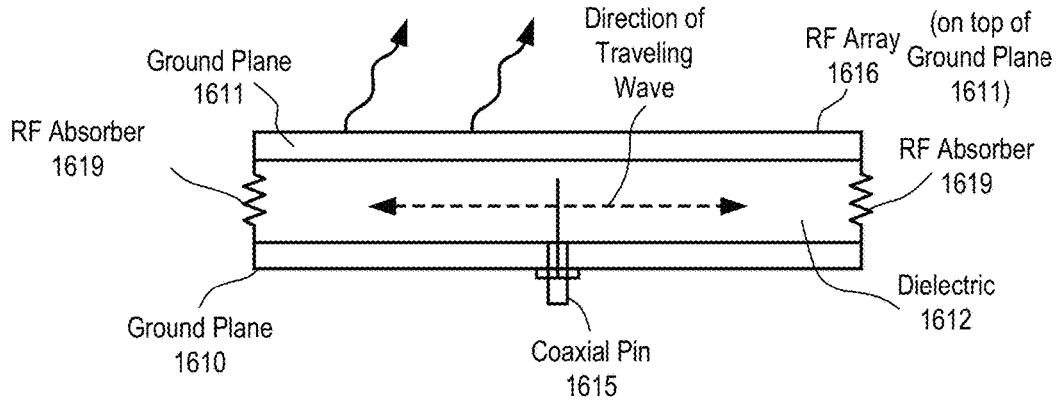
FIG. 11 illustrates another embodiment of the antenna system with an outgoing wave.

FIG. 11 illustrates another embodiment of the antenna system with an outgoing wave. Referring to FIG. 11, two ground planes 1610 and 1611 are substantially parallel to each other with a dielectric layer 1612 (e.g., a plastic layer, etc.) in between ground planes. RF absorbers 1619 (e.g., resistors) couple the two ground planes 1610 and 1611 together. A coaxial pin 1615 (e.g., 50Ω) feeds the antenna. An RF array 1616 is on top of dielectric layer 1612 and ground plane 1611.

In operation, a feed wave is fed through coaxial pin 1615 and travels concentrically outward and interacts with the elements of RF array 1616.

The cylindrical feed in both the antennas of FIGS. 10 and 11 improves the service angle of the antenna. Instead of a service angle of plus or minus forty-five degrees azimuth (±45° Az) and plus or minus twenty-five degrees elevation (±25° El), in one embodiment, the antenna system has a service angle of seventy-five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1606 of FIG. 10 and RF array 1616 of FIG. 11 include a wave scattering subsystem that includes a group of patch antennas (i.e., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELL") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty-five degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 12:
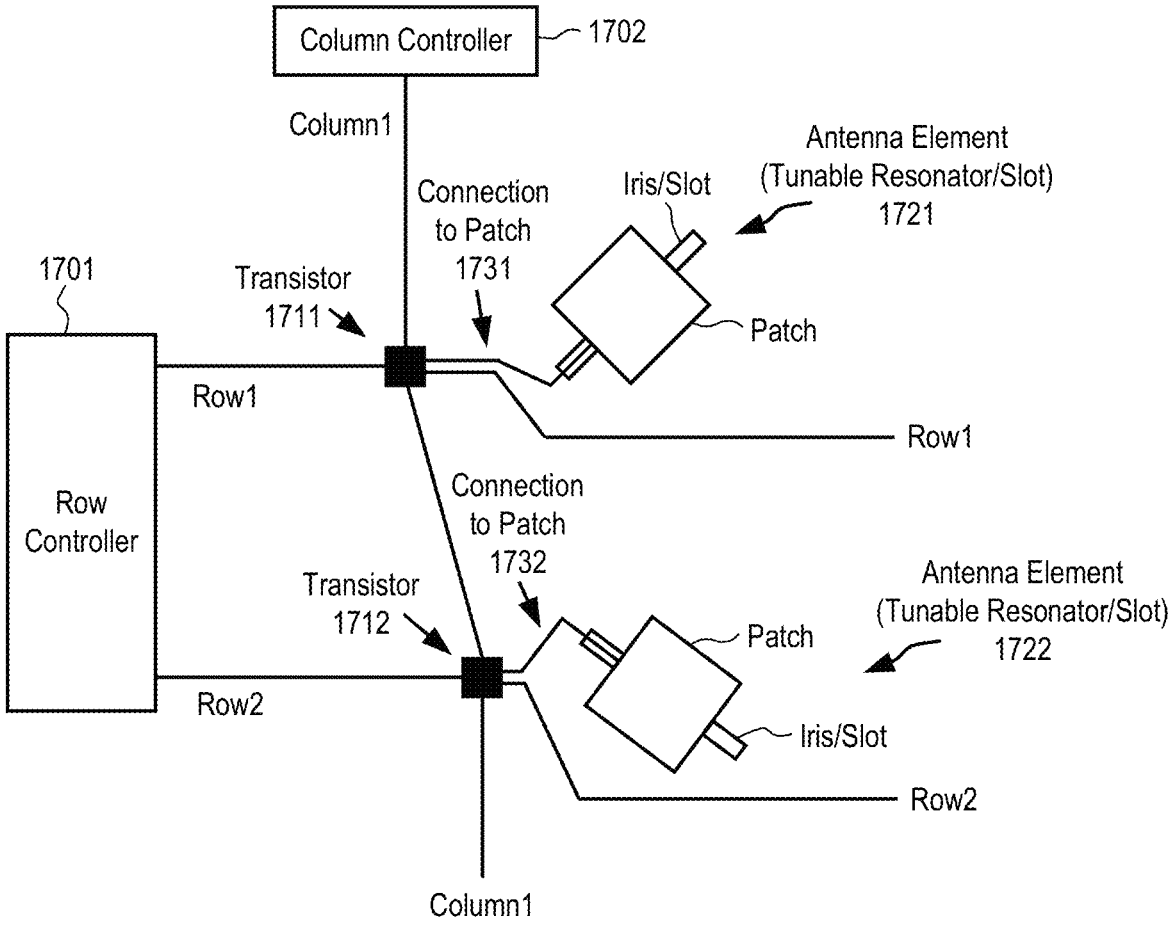
FIG. 12 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 12 illustrates one embodiment of the placement of matrix drive circuitry with respect to antenna elements. Referring to FIG. 12, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercially available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 13:
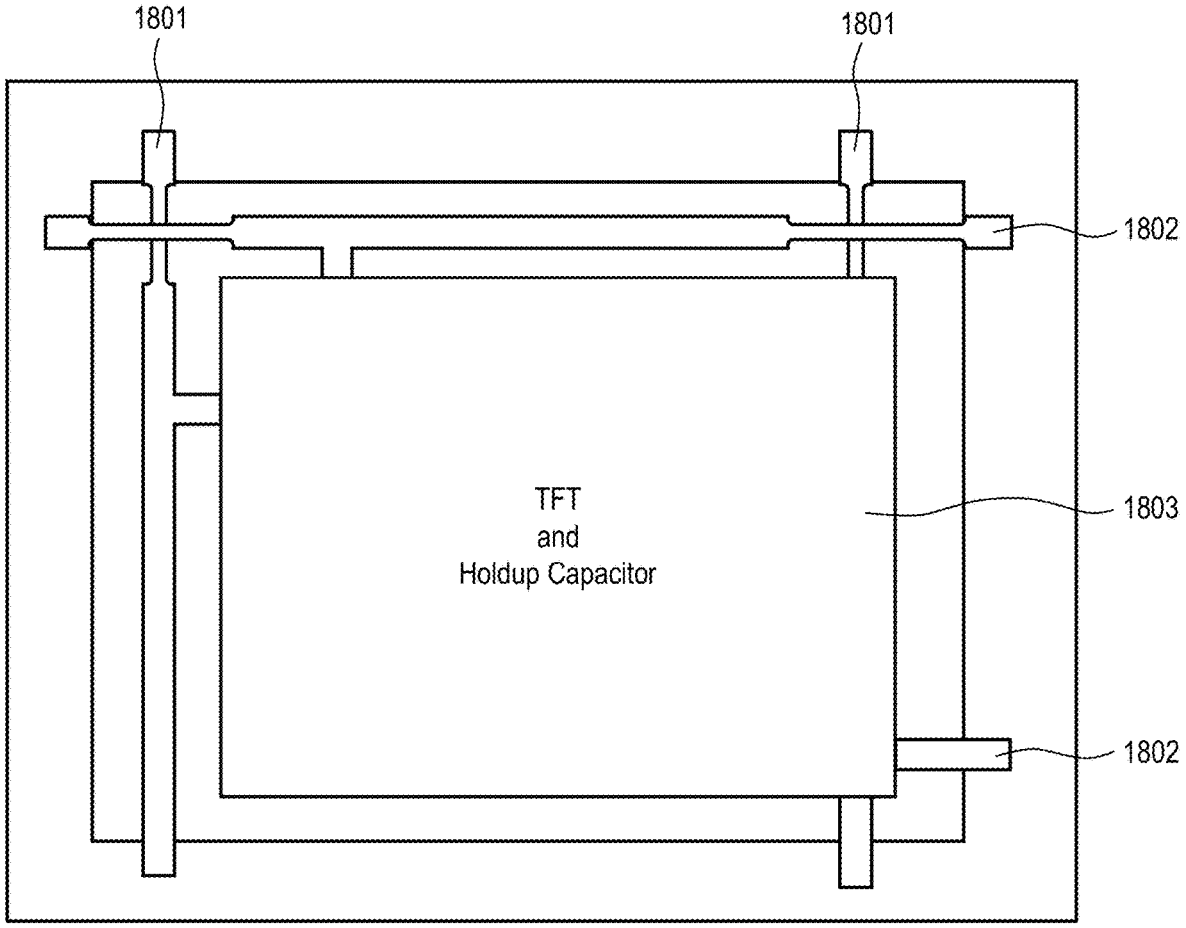
FIG. 13 illustrates one embodiment of a TFT package.

In one embodiment, a TFT package is used to enable placement and unique addressing in the matrix drive. FIG. 13 illustrates one embodiment of a TFT package. Referring to FIG. 13, a TFT and a hold capacitor 1803 is shown with input and output ports. There are two input ports connected to traces 1801 and two output ports connected to traces 1802 to connect the TFTs together using the rows and columns. In one embodiment, the row and column traces cross in 90° angles to reduce, and potentially minimize, the coupling between the row and column traces. In one embodiment, the row and column traces are on different layers.

An Example of a Full Duplex Communication System

Figure 14:
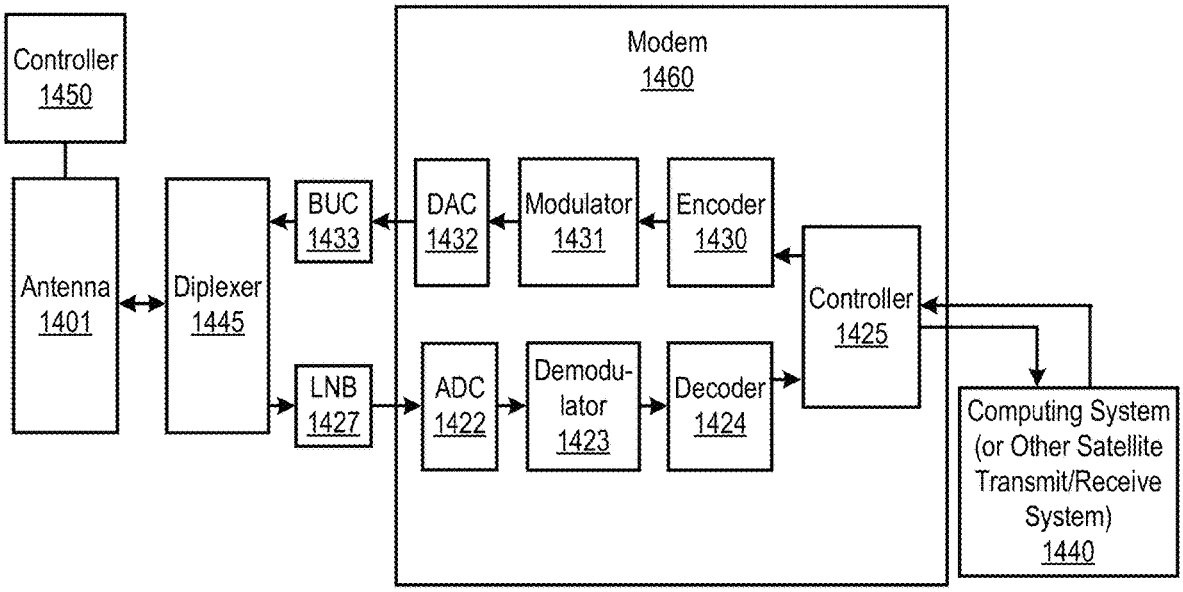
FIG. 14 is a block diagram of another embodiment of a communication system having simultaneous transmit and receive paths.

In another embodiment, the combined antenna apertures are used in a full duplex communication system. FIG. 14 is a block diagram of another embodiment of a communication system having simultaneous transmit and receive paths. While only one transmit path and one receive path are shown, the communication system may include more than one transmit path and/or more than one receive path.

Referring to FIG. 14, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNBs) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (up-convert and high pass amplifier) 1433 and provided to one port of diplexer 1445. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

The communication system would be modified to include the combiner/arbiter described above. In such a case, the combiner/arbiter after the modem but before the BUC and LNB.

Note that the full duplex communication system shown in FIG. 14 has a number of applications, including but not limited to, internet communication, vehicle communication (including software updating), etc.

There is a number of example embodiments described herein.

Example 1 is an antenna comprising: an aperture having an array of radio-frequency (RF) radiating antenna elements and a segmented wedge plate radial waveguide comprises a plurality of wedge plates that form a plurality of sub-apertures, wherein each sub-aperture includes one wedge plate and a distinct subset of RF radiating antenna elements in the array, wherein each wedge plate of the plurality of wedge plates has a feed point to provide a feed wave for propagation through said each wedge plate for interaction with its distinct subset of RF radiating antenna elements in the array.

Example 2 is the antenna of example 1 that may optionally include a boundary structure between adjacent sides of adjacent sub-apertures.

Example 3 is the antenna of example 2 that may optionally include that the boundary structure is a perfect electrical conductor (PEC) boundary.

Example 4 is the antenna of example 1 that may optionally include that the plurality of sub-apertures are coupled to form the aperture in a cylindrical shape or a rectangular shape.

Example 5 is the antenna of example 4 that may optionally include that feed points of the plurality of wedge plates are located centrally with respect to the cylindrically-shaped aperture.

Example 6 is the antenna of example 1 that may optionally include that the aperture comprises a metasurface with surface scattering antenna elements.

Example 7 is the antenna of example 1 that may optionally include that the aperture is operable to generate multiple beams simultaneously, at least two of the beams being generated via at least two wedge plates of the plurality of wedge plates.

Example 8 is the antenna of example 7 that may optionally include processing circuitry to perform spatial discrimination to determine on which of the multiple beams a signal is received.

Example 9 is the antenna of example 1 that may optionally include a plurality of RF chains and a plurality of ports, wherein one RF chain in the plurality of RF chains is coupled to one port of the plurality of ports and each port is associated with one sub-aperture of the plurality of sub-apertures.

Example 10 is the antenna of example 1 that may optionally include that the plurality of sub-apertures are operated coherently together by, at least in part, coordinating feed wave propagation through the plurality of wedge plates.

Example 11 is the antenna of example 1 that may optionally include that each sub-aperture comprises a directional coupler.

Example 12 is the antenna of example 1 that may optionally include that at least one wedge plate of the plurality of wedge plates is fed with a first feed wave that is time-delayed with respect to a second feed wave that is fed to another wedge plate of the plurality of wedge plates.

Example 13 is the antenna of example 1 that may optionally include that the wedge plates of the plurality of wedge plates are identical to each other.

Example 14 is an antenna comprising: an aperture having an array of radio-frequency (RF) radiating antenna elements, a segmented wedge plate radial waveguide comprises a plurality of wedge plates that form a plurality of sub-apertures, wherein the plurality of sub-apertures are coupled to form the aperture in a cylindrical shape, wherein each sub-aperture includes one wedge plate and a distinct subset of RF radiating antenna elements in the array and each wedge plate of the plurality of wedge plates has a feed point to provide a feed wave for interaction with its distinct subset of RF radiating antenna elements in the array, and further wherein feed points of the plurality of wedges are located centrally with respect to the cylindrical-shaped aperture to propagate the feed wave radially outward from the centrally-located feed points, and a boundary structure between adjacent sides of adjacent sub-apertures.

Example 15 is the antenna of example 14 that may optionally include that the boundary structure is a perfect electrical conductor (PEC) boundary.

Example 16 is the antenna of example 14 that may optionally include that the aperture comprises a metasurface with surface scattering antenna elements.

Example 17 is the antenna of example 14 that may optionally include that the aperture is operable to generate multiple beams simultaneously, at least two of the beams being generated via at least two wedge plates of the plurality of wedge plates, and further comprising processing circuitry to perform spatial discrimination to determine on which of the multiple beams a signal is received.

Example 18 is the antenna of example 14 that may optionally include a plurality of RF chains and a plurality of ports, wherein one RF chain in the plurality of RF chains is coupled to one port of the plurality of ports and each port is associated with one sub-aperture of the plurality of sub-apertures.

Example 19 is the antenna of example 14 that may optionally include that the plurality of sub-apertures are operated coherently together by, at least in part, coordinating feed wave propagation through the plurality of wedge plates.

Example 20 is an antenna comprising: an aperture having a metasurface with surface scattering antenna elements; a segmented wedge plate radial waveguide comprises a plurality of wedge plates that form a plurality of sub-apertures, wherein each sub-aperture includes one wedge plate and a distinct subset of surface scattering antenna elements and each wedge plate of the plurality of wedge plates has a feed point centrally-located with respect to the aperture to provide a feed wave propagating radially outward for interaction with its distinct subset of surface scattering antenna elements, wherein the aperture is operable to generate multiple beams simultaneously, at least two of the beams being generated via at least two wedge plates of the plurality of wedge plates, and a boundary structure between adjacent sides of adjacent sub-apertures; and processing circuitry to perform spatial discrimination to determine on which of the multiple beams a signal is received.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

What is claimed is:

1. An antenna comprising:

an aperture having a segmented wedge plate radial waveguide comprising a plurality of wedge plates that form a plurality of sub-apertures, wherein each sub-aperture includes one of the plurality of wedge plates and a distinct subset of radio-frequency (RF) radiating antenna elements in an array of RF radiating antenna elements, wherein each wedge plate of the plurality of wedge plates has a feed point to provide a feed wave for propagation through said each wedge plate for interaction with its distinct subset of RF radiating antenna elements in the array, and a plurality of RF chains and a plurality of ports, wherein one RF chain in the plurality of RF chains is coupled to one port of the plurality of ports and each port is associated with one sub-aperture of the plurality of sub-apertures.

2. The antenna of claim 1 further comprising a boundary structure between adjacent sides of adjacent sub-apertures.

3. The antenna of claim 2 wherein the boundary structure is a perfect electrical conductor (PEC) boundary.

4. The antenna of claim 1 wherein the sub-apertures of the plurality of sub-apertures are coupled to form the aperture in a cylindrical shape or a rectangular shape.

5. The antenna of claim 4 wherein feed points of the plurality of wedge plates are located centrally with respect to the cylindrically-shaped aperture.

6. The antenna of claim 1 wherein the aperture comprises a metasurface with surface scattering antenna elements.

7. The antenna of claim 1 wherein the aperture is operable to generate multiple beams simultaneously, at least two of the beams being generated via at least two wedge plates of the plurality of wedge plates.

8. The antenna of claim 7 further comprising processing circuitry to perform spatial discrimination to determine on which of the multiple beams a signal is received.

9. The antenna of claim 1 wherein the sub-apertures of the plurality of sub-apertures are operated coherently together by, at least in part, coordinating feed wave propagation through the plurality of wedge plates.

10. The antenna of claim 1 wherein each sub-aperture comprises a directional coupler.

11. The antenna of claim 1 wherein the wedge plates of the plurality of wedge plates are identical to each other.

12. An antenna comprising:

an aperture having a segmented wedge plate radial waveguide comprising a plurality of wedge plates that form a plurality of sub-apertures, wherein each sub-aperture includes one of the plurality of wedge plates and a distinct subset of radio-frequency (RF) radiating antenna elements in an array of RF radiating antenna elements, wherein each wedge plate of the plurality of wedge plates has a feed point to provide a feed wave for propagation through said each wedge plate for interaction with its distinct subset of RF radiating antenna elements in the array, wherein at least one wedge plate of the plurality of wedge plates is fed with a first feed wave that is time-delayed with respect to a second feed wave that is fed to another wedge plate of the plurality of wedge plates.

13. An antenna comprising:

an aperture having a metasurface with surface scattering antenna elements;

a segmented wedge plate radial waveguide comprising a plurality of wedge plates that form a plurality of sub-apertures, wherein each sub-aperture includes one of the plurality of wedge plates and a distinct subset of the surface scattering antenna elements and each wedge plate of the plurality of wedge plates has a feed point centrally-located with respect to the aperture to provide a feed wave propagating radially outward for interaction with its distinct subset of surface scattering antenna elements, wherein the aperture is operable to generate multiple beams simultaneously, at least two of the beams being generated via at least two wedge plates of the plurality of wedge plates, and a boundary structure between adjacent sides of adjacent sub-apertures; and processing circuitry to perform spatial discrimination to determine on which of the multiple beams a signal is received.

* * * * *